US008857906B2

(12) United States Patent
Connors

(10) Patent No.: US 8,857,906 B2
(45) Date of Patent: Oct. 14, 2014

(54) PELVIS SUPPORT ASSEMBLY

(71) Applicant: Posture & Purpose, LLC, Ann Arbor, MI (US)

(72) Inventor: Patricia Connors, Ann Arbor, MI (US)

(73) Assignee: Posture & Purpose, LLC, Ann Arbor, MI (US)

( * ) Notice: Subject to any disclaimer, the term of this patent is extended or adjusted under 35 U.S.C. 154(b) by 0 days.

(21) Appl. No.: 13/832,192

(22) Filed: Mar. 15, 2013

(65) Prior Publication Data

US 2014/0265486 A1 Sep. 18, 2014

(51) Int. Cl.
*A47C 7/14* (2006.01)
*A47C 20/04* (2006.01)
*A61G 7/07* (2006.01)

(52) U.S. Cl.
CPC .. *A47C 20/04* (2013.01); *A61G 7/07* (2013.01)
USPC ..... 297/230.14; 297/230.13

(58) Field of Classification Search
CPC ..... A47B 2200/0098; A61G 7/0755; A61G 7/07; A47C 20/04
USPC ..... 297/DIG. 10, 313, 423.14, 230.14
See application file for complete search history.

(56) References Cited

U.S. PATENT DOCUMENTS

| | | | | | |
|---|---|---|---|---|---|
| 1,452,915 | A | * | 4/1923 | Kennedy | 5/648 |
| 3,284,817 | A | * | 11/1966 | Landwirth | 5/647 |
| 4,549,767 | A | * | 10/1985 | Hampshire et al. | 297/423.46 |
| 4,561,649 | A | * | 12/1985 | Forsythe | 482/80 |
| 5,294,180 | A | * | 3/1994 | Grimm | 297/423.44 |
| 5,419,618 | A | * | 5/1995 | Hatcher | 297/423.46 |
| 5,423,280 | A | * | 6/1995 | Kelley | 114/363 |
| D473,272 | S | * | 4/2003 | Heins | D21/685 |

* cited by examiner

*Primary Examiner* — Milton Nelson, Jr.
(74) *Attorney, Agent, or Firm* — Buckert Patent & Trademark Law Firm, P.C.; John F. Buckert

(57) ABSTRACT

A pelvis support assembly is provided. The assembly includes a bottom plate having a first end portion and a second end portion. The assembly further includes a pelvis support plate having a first end portion and a second end portion. The first end portion of the pelvis support plate is pivotally coupled to the first end portion of the bottom plate. The pelvis support plate is sized to support a human pelvis region thereon. The assembly further includes a positional adjustment member operably coupled between the bottom plate and the pelvis support plate. The positional adjustment member holds the pelvis support plate at one of a plurality of operational positions relative to the bottom plate.

15 Claims, 19 Drawing Sheets

PELVIS SUPPORT ASSEMBLY

BACKGROUND

When a human being is a sitting position, the human pelvis tends to tip/roll backwards into a posterior rotation position or a posterior tilt position, also known as a "slumped" position. This slumped position causes the normal inward curve of the lumbar spine (lordosis) to flatten or reverse, which places increased non-anatomical positional stress on lumbar muscles, ligaments, and discs.

Accordingly, the inventor herein has recognized a need for an improved pelvis support assembly that minimizes and/or eliminates the above-mentioned deficiency.

SUMMARY

A pelvis support assembly in accordance with an exemplary embodiment is provided. The pelvis support assembly includes a bottom plate having a first end portion and a second end portion. The pelvis support assembly further includes a pelvis support plate having a first end portion and a second end portion. The first end portion of the pelvis support plate is pivotally coupled to the first end portion of the bottom plate. The pelvis support plate is sized to support a human pelvis region thereon. The pelvis support assembly further includes a positional adjustment member operably coupled between the bottom plate and the pelvis support plate. The positional adjustment member is configured to hold the pelvis support plate at one of a plurality of operational positions relative to the bottom plate.

A pelvis support assembly in accordance with another exemplary embodiment is provided. The pelvis support assembly includes a substantially wedge-shaped member having a bottom surface, a support surface, and a rear surface. The support surface has a first end and a second end. The bottom surface has a first end and a second end. The support surface extends at a predetermined angle relative to the first end of the bottom surface. The rear surface extends from the second end of the support surface to the second end of the bottom surface. The support surface is sized to support a human pelvis region thereon. The pelvis support assembly further includes a rigid plate coupled to the bottom surface of the substantially wedge-shaped member

DETAILED DESCRIPTION

Figure 1:
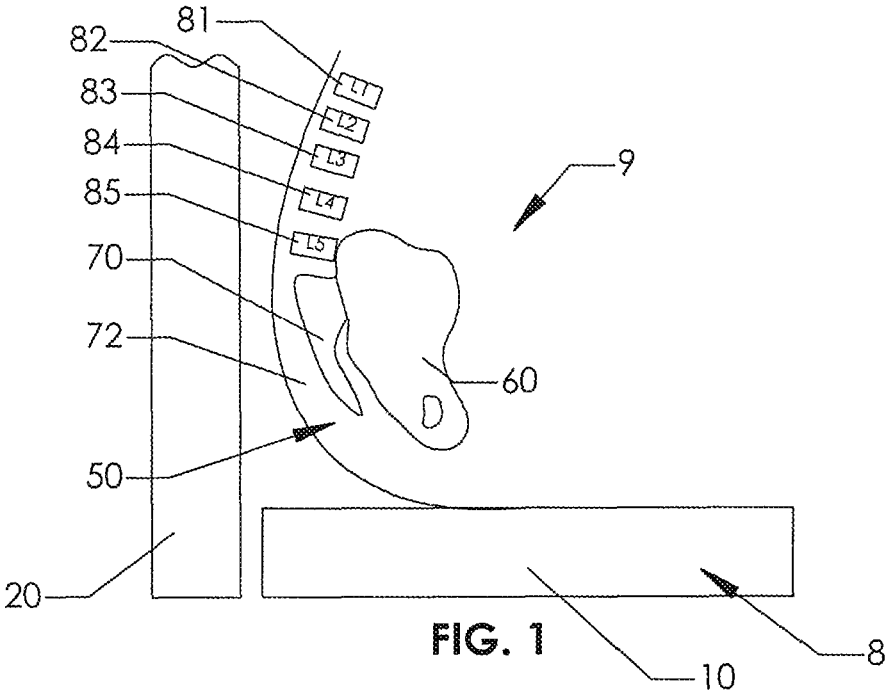
FIG. 1 is a simplified schematic of a portion of a chair, and a portion of a pelvis region and vertebrates of a human being in a slumped position.
Figure 2:
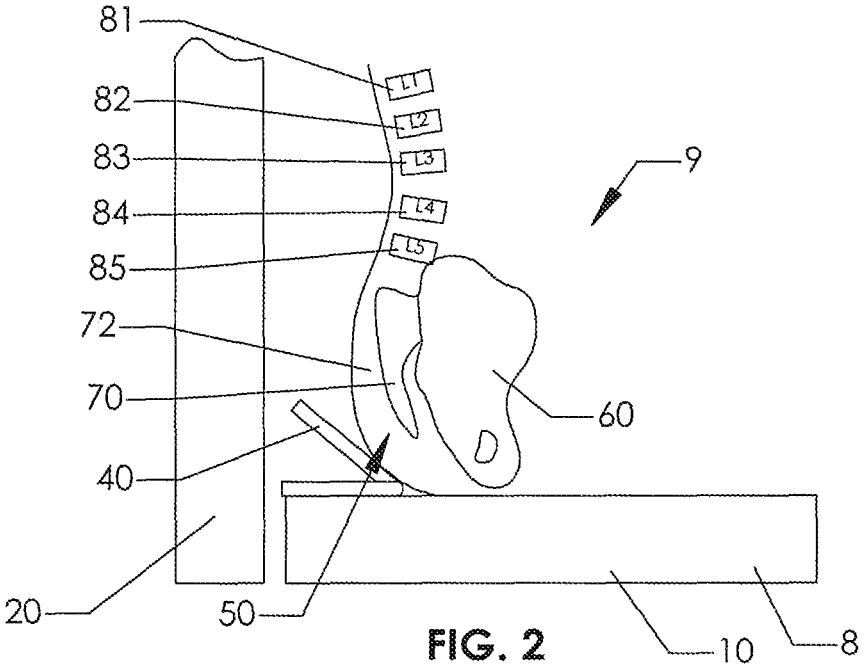
FIG. 2 is a simplified schematic of a portion of a chair, a portion of a pelvis region and vertebrates of a human being in a desired position, and a pelvis support assembly in accordance with an exemplary embodiment.

Referring to FIGS. 1 and 2, a portion of a chair 8, a portion of a human being 9, and a pelvis support assembly 40 in accordance with an exemplary embodiment are illustrated. The chair 8 includes a seat bottom 10 and a seat back 20. The human being 9 includes a pelvis region 50 having a pelvis bone 60, a sacrum and tailbone 70, and a buttocks portion 72. The human being 9 further includes vertebrates 81, 82, 83, 84, 85. The pelvis support assembly 40 is advantageously configured to support the pelvis region 50 such that the vertebrates 81-85 have a normal inward curve for decreased stress on the lumbar muscles, ligaments, and discs.

Referring to FIG. 1, when the pelvis support assembly 40 is not utilized to support the pelvis region 50, the pelvis region 50 tends to tip/roll backwards into a slumped position. This slumped position causes the normal inward curve of the lumbar spine (lordosis) to flatten or reverse, which places increased non-anatomical positional stress on lumbar muscles, ligaments, and discs.

First Pelvis Support Assembly Embodiment

Referring to FIGS. 2, 3, 4 and 10, the pelvis support assembly 40 in accordance with an exemplary embodiment is illustrated. The pelvis support assembly 40 includes a bottom plate 100, a pelvis support plate 110, a positional adjustment member 120, pins 130, 132, hinge members 140, 142, an anti-skid cover member 150, and an anti-skid layer 160. An advantage of the pelvis support assembly 40 is that the assembly 40 supports the pelvis region 50 such that the vertebrates 81-85 having normal inward curve for decreased stress on the lumbar muscles, ligaments, and discs.

Figure 6:
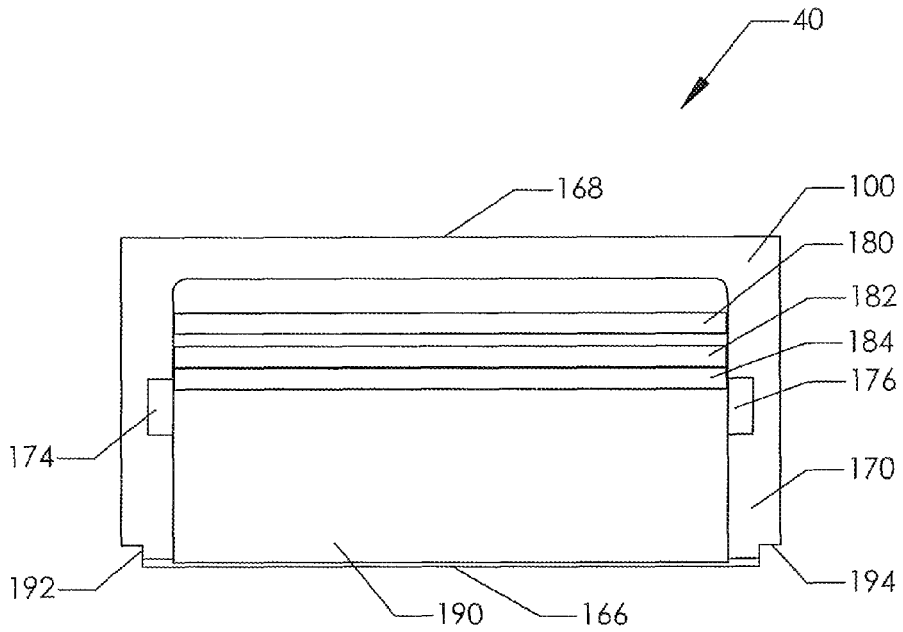
FIG. 6 is a top view of a bottom plate of the pelvis support assembly of FIG. 3.
Figure 10:
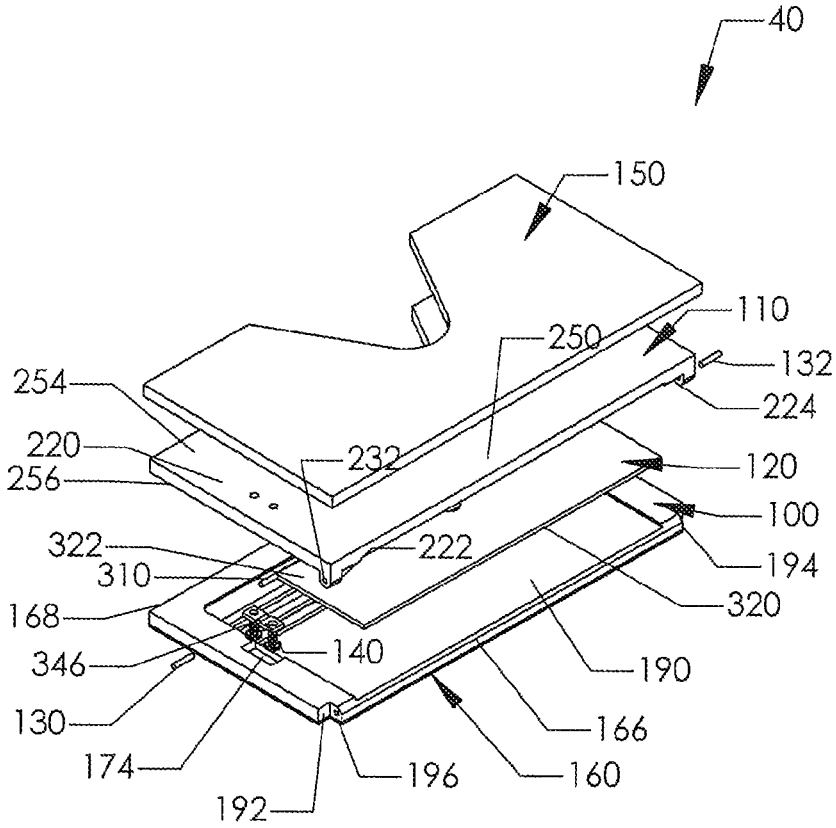
FIG. 10 is an exploded view of the pelvis support assembly of FIG. 3.
Figure 11:
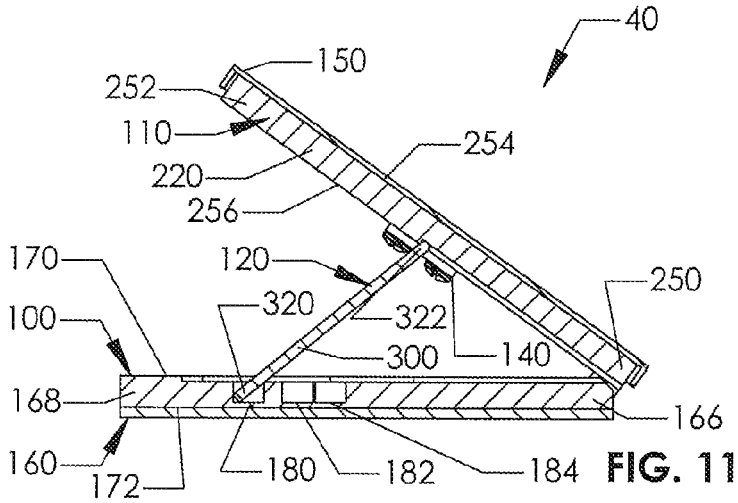
FIG. 11 is a cross-sectional view of the pelvis support assembly of FIG. 3 when a pelvis support plate therein has a first operational position.

Referring to FIGS. 6, 10 and 11, the bottom plate 100 is provided to operationally support the positional adjustment member 120 and the pelvis support plate 110 thereon. In one exemplary embodiment, the bottom plate 100 is constructed of plastic. In an alternative embodiment, the bottom plate 100 could be constructed of other materials known to those skilled in the art such as steel, stainless steel, aluminum, or wood for example. The bottom plate 100 includes a first end portion 166 and a second end portion 168. The bottom plate 100 further includes a top surface 170 and a bottom surface 172 disposed opposite to the top surface 170.

Referring to FIGS. 3-6 and 10, the bottom plate 100 further includes grooves 174, 176, 180, 182, 184, 190 extending from the top surface 170 into the bottom plate 100. The grooves 174, 176 are configured to receive the hinge members 140, 142 therein when the pelvis support plate 110 is disposed proximate to the bottom plate 100 when the pelvis support assembly 40 has a stored operational position. The grooves 180, 182 are each configured to receive a portion of the positional adjustment member 120 therein for adjusting an operational angle of the pelvis support plate 110. The groove 190 is configured to receive the positional adjustment member 120 therein when the pelvis support assembly 40 has a closed operational position.

Referring to FIGS. 10 and 11, the bottom plate 100 further includes cut-out corner regions 192, 194 for receiving corresponding hinge extension portions 222, 224, respectively, of the pelvis support plate 110 therein. An aperture 196 communicating with the cut-out corner region 192 extends into the first end portion 166 of the bottom plate 100 for receiving a pin 130 therein. In particular, the pin 130 extends through an aperture 232 in the hinge extension portion 222 and the aperture 196 to rotatably couple the first end portion 250 of the pelvis support plate 110 to the first end portion 166 of the bottom plate 100. Similarly, an aperture (not shown) communicating with the cut-out corner region 194 extends into the first end portion 166 of the bottom plate 100 for receiving a pin 132 therein. In particular, the pin 132 extends through an aperture 234 (shown in FIG. 4) in the hinge extension portion 224 and the aperture proximate to the cut-out corner region 194 to rotatably couple the first end portion 250 of the pelvis support plate 110 to the first end portion 166 of the bottom plate 100.

Referring to FIGS. 2, 3-5 and 11, the pelvis support plate 110 is configured to support the pelvis region 50 of the human being 9. In one exemplary embodiment, the pelvis support plate 110 is constructed of plastic. In an alternative embodiment, the pelvis support plate 110 could be constructed of other materials known to those skilled in the art such as steel, stainless steel, aluminum, or wood for example. The pelvis support plate 110 includes a plate portion 220 and hinge extension portions 222, 224. The plate portion 220 includes a first end portion 250 and a second end portion 252. The plate portion 220 further includes a top surface 254 and a bottom surface 256 disposed opposite to the top surface 254.

Figure 3:
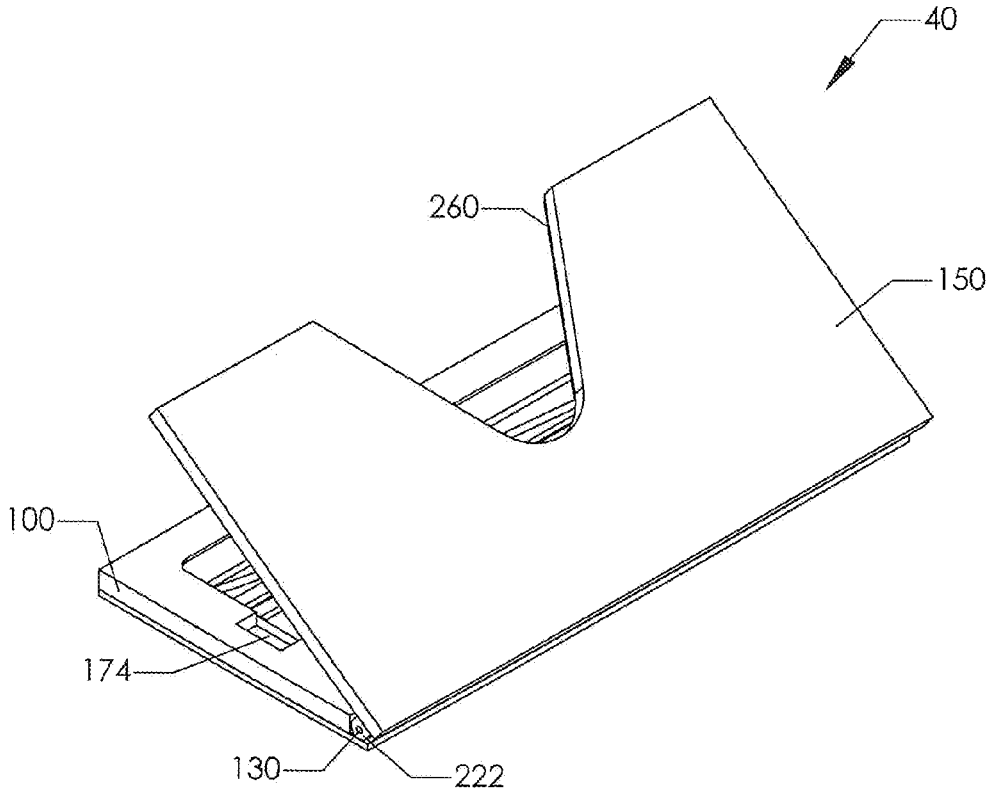
FIG. 3 is a schematic of the pelvis support assembly of FIG. 2 in accordance with an exemplary embodiment.
Figure 7:
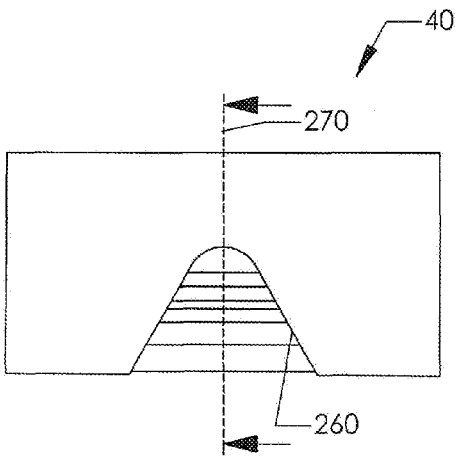
FIG. 7 is a top view of the pelvis support assembly of FIG. 3 when the pelvis support assembly has a closed operational position.
Figure 8:
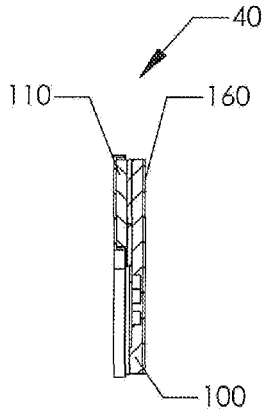
FIG. 8 is a cross-sectional view of the pelvis support assembly of FIG. 3 when the pelvis support assembly has a closed operational position.
Figure 9:
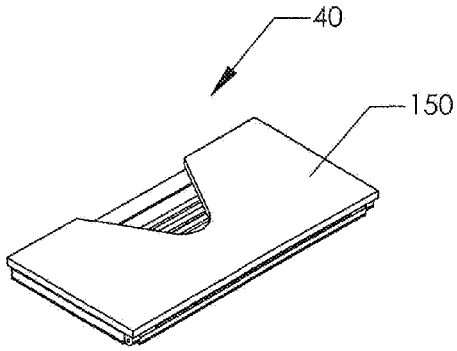
FIG. 9 is another schematic of the pelvis support assembly of FIG. 3 when the pelvis support assembly has a closed operational position.

Referring to FIGS. 2, 3 and 7, the plate portion 220 has a cut-out portion 260 configured to allow the sacrum and tailbone 70 of the human pelvis region 50 to have a decreased pressure applied thereto from the plate portion 220. In particular, the cut-out portion 260 is centered about a centrally positioned axis 270 on the plate portion 220 extending between the first and second end portions 250, 252 (shown in FIG. 5) of the plate portion 220. The cut-out portion 260 extends from the second end portion 252 a predetermined distance toward the first end portion 250.

Figure 4:
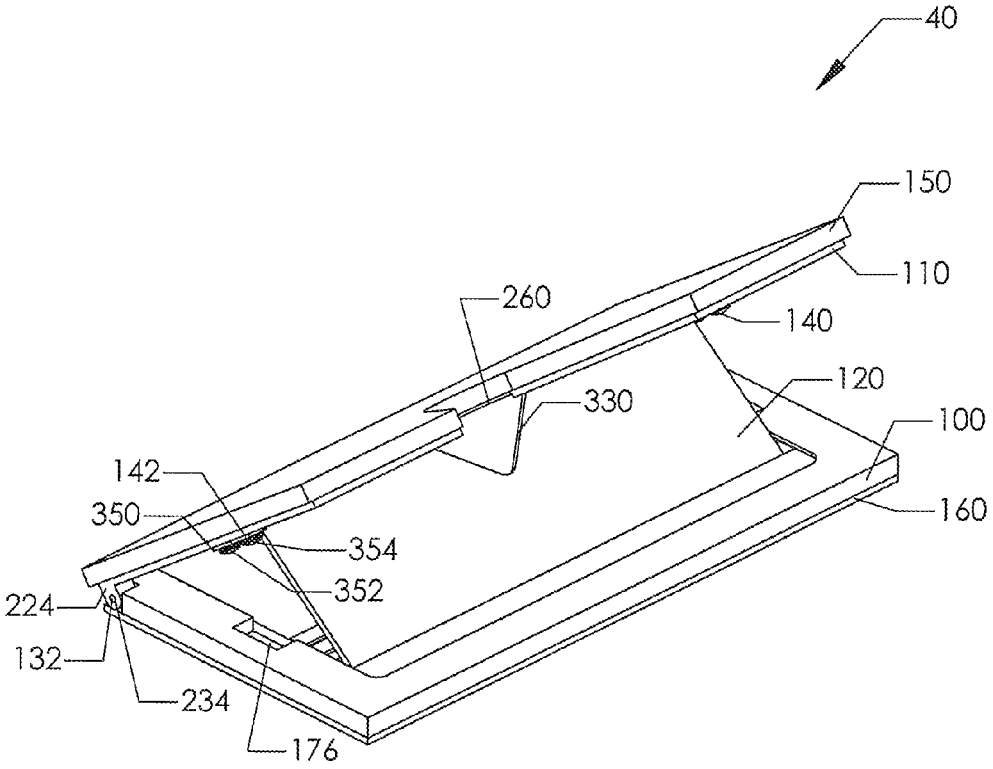
FIG. 4 is another schematic of the pelvis support assembly of FIG. 3.
Figure 5:
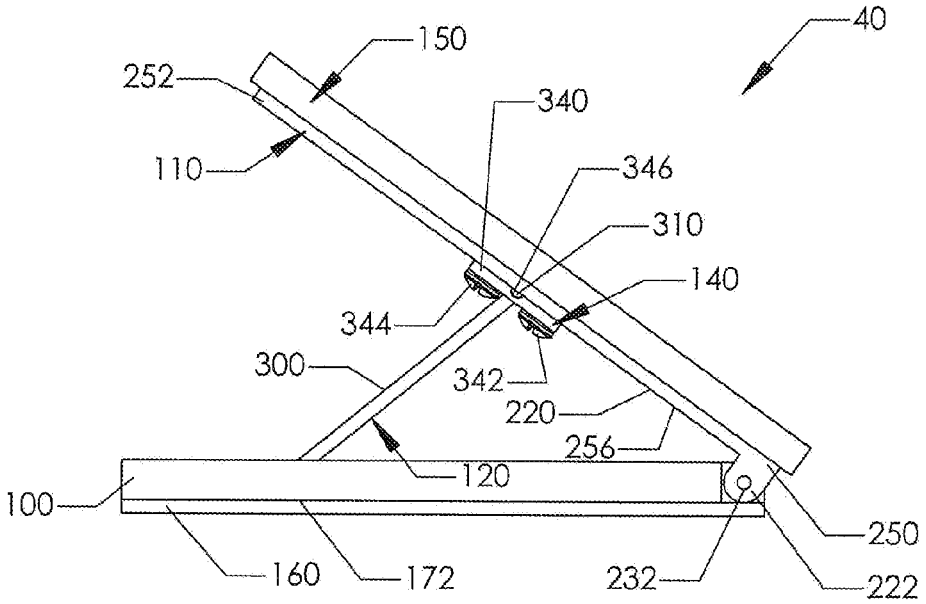
FIG. 5 is a side view of the pelvis support assembly of FIG. 3.

Referring to FIGS. 4, 5 and 10, the hinge extension portions 222, 224 are disposed on opposite corners of the first end portion 250 of the plate portion 220 of the pelvis support plate 110. The hinge extension portions 222, 224 extend downwardly from a bottom surface 256 of the plate portion 220. The hinge extension portion 222 includes an aperture 232 extending therethrough, and the hinge extension portion 224 includes an aperture 234 (shown in FIG. 4) extending therethrough. The apertures 232, 234 are disposed co-linear with one another. The aperture 232 is configured to receive the pin 130 therethrough for rotatably coupling the hinge extension portion 222 to the first end portion 250 of the bottom plate 100. Also, that aperture 234 is configured to receive the pin 132 therethrough for rotatably coupling the hinge extension portion 224 to the first end portion 250 of the bottom plate 100.

Referring to FIGS. 4, 5 and 11-13, the positional adjustment member 120 is operably positioned between the bottom plate 100 and the pelvis support plate 110 to adjust an operational position of the pelvis support plate 110. The positional adjustment member 120 configured to hold the pelvis support plate 110 at one of a plurality of operational positions relative to the bottom plate 100. In one exemplary embodiment, the positional adjustment member 120 is constructed of plastic. In an alternative embodiment, the positional adjustment member 120 could be constructed of other materials known to those skilled in the art such as steel, stainless steel, aluminum, or wood for example. The positional adjustment member 120 includes a plate portion 300, a pin extension 310 (shown in FIGS. 5 and 10), and another pin extension (not shown).

Referring to FIGS. 5 and 10, the pin extension 310 extends outwardly in a first direction from the second end portion 322 of the plate portion 300 of the positional adjustment member 120. The pin extension 310 is configured to be received within a groove 346 of the hinge member 140 such that the pelvis support plate 110 is pivotally coupled to the positional adjustment member 120.

The other pin extension (not shown) extends outwardly in a second direction (opposite to the first direction of the pin extension 310) from the second end portion 322 of the plate portion 300. This other pin extension (not shown) is configured to be received within a groove of the hinge member 142 (shown in FIG. 4) such that the pelvis support plate 110 is pivotally coupled to the positional adjustment member 120.

Referring to FIGS. 5 and 11, the hinge member 140 is configured to rotatably couple the second end portion 322 of the positional adjustment member 120 with the pelvis support plate 110. The hinge member 140 includes a plate 340 having a pair of apertures extending therethrough that are configured to receive the bolts 342, 344 therethrough for coupling the plate 340 to the pelvis support plate 110. The plate 340 further includes a groove 346 for receiving the pin extension 310 of the positional adjustment member 120 therethrough.

Similarly, referring to FIG. 4, the hinge member 142 is configured to rotatably couple the second end portion 322 of the positional adjustment member 120 with the pelvis support plate 110. The hinge member 142 includes a plate 350 having a pair of apertures extending therethrough that are configured to receive the bolts 352, 354 therethrough for coupling the plate 350 to the pelvis support plate 110. The plate 350 further includes a groove for receiving another pin extension (not shown) of the positional adjustment member 120 therethrough. In an alternative embodiment, other types of hinges could be utilized for hinge members 140, 142.

Referring to FIGS. 6 and 11-13, a brief description of a method of adjusting an operational position of the pelvis support plate 110 utilizing the positional adjustment member 120 will be explained. In one exemplary embodiment, the bottom plate 166 includes grooves 180, 182, 184 extending therein. In one exemplary embodiment, the positional adjustment member 120 can adjust an operational position of the pelvis support plate 110 relative to the bottom plate 100 corresponding to an angular range of 35-50 degrees.

Referring to FIG. 11, when the first end portion 320 of the positional adjustment member 122 is disposed in the groove 180, the positional adjustment member 122 holds the pelvis support plate 110 at a first operational position of the plurality of operational positions relative to the bottom plate 100. In one exemplary embodiment, the first operational position corresponds to a 35° angle of inclination of the pelvis support plate 110 relative to the bottom plate 100.

Figure 12:
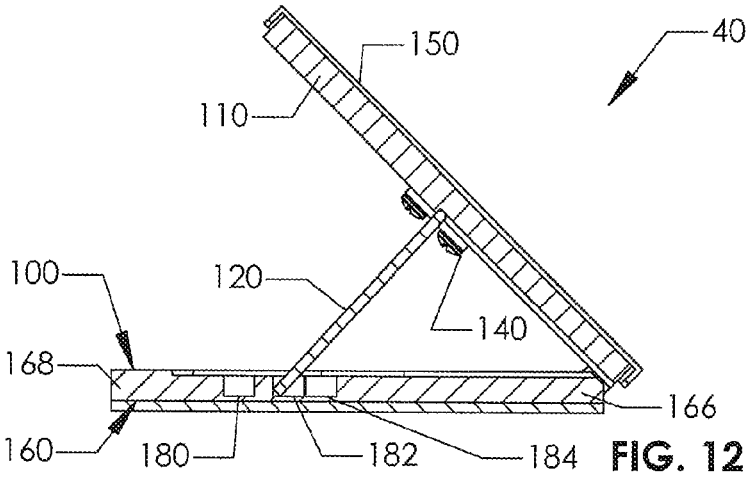
FIG. 12 is a cross-sectional view of the pelvis support assembly of FIG. 3 when the pelvis support plate therein has a second operational position.

Referring to FIG. 12, when the first end portion 320 of the positional adjustment member 122 is disposed in the groove 182, the positional adjustment member 122 holds the pelvis support plate 110 at a second operational position of a plurality of operational positions relative to the bottom plate 100. In one exemplary embodiment, the second operational position corresponds to a 45° angle of inclination of the pelvis support plate 110 relative to the bottom plate 100.

Figure 13:
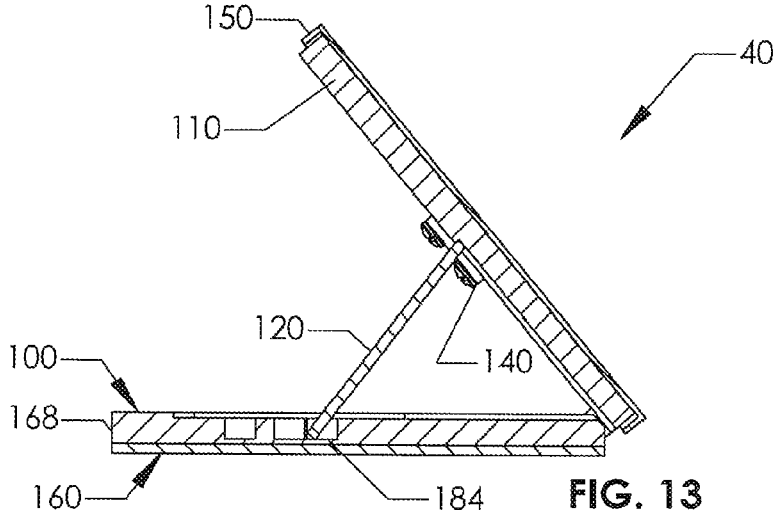
FIG. 13 is a cross-sectional view of the pelvis support assembly of FIG. 3 when the pelvis support plate therein has a third operational position.

Referring to FIG. 13, when the first end portion 320 of the positional adjustment member 122 is disposed in the groove 184, the positional adjustment member 122 holds the pelvis support plate 110 at a third operational position of a plurality of operational positions relative to the bottom plate 100. In one exemplary embodiment, the second operational position corresponds to a 50° angle of inclination of the pelvis support plate 110 relative to the bottom plate 100.

Referring to FIGS. 3-5,10 and 11, the anti-skid cover member 150 is configured to be disposed on at least an outer surface 254 of the pelvis support plate 110, and/or may further extend to the bottom surface 256. The anti-skid cover member 150 may further be disposed around peripheral edges of the pelvis support plate 110. In one exemplary embodiment, the anti-skid cover member 150 is constructed of a plastic having anti-skid characteristics. In an alternative embodiment, the anti-skid cover member 150 could be constructed of other materials known to those skilled in the art such as elastomeric materials.

Referring to FIGS. 2 and 5, the anti-skid layer 160 is configured to minimize and/or prevent the pelvis support assembly 40 from sliding on the seat bottom 10. The anti-skid layer 160 is disposed on a bottom surface 172 of the bottom plate 100.

Referring to FIGS. 7-10, the pelvis support assembly 40 has a compact closed operational position such that positional adjustment member 120 is disposed in the groove 190 of the bottom plate 100, and the pelvis support plate 110 is disposed adjacent to the bottom plate 100.

Second Pelvis Support Assembly Embodiment

Referring to FIGS. 2, 14, 15 and 19, a pelvis support assembly 440 in accordance with an exemplary embodiment is illustrated. The pelvis support assembly 440 supports the pelvis region 50 of the human being 9 when the human being 9 is in a sitting position. The pelvis support assembly 440 includes a bottom plate 500, a pelvis support plate 510, a positional adjustment member 520, pins 530, 532, hinge members 540, 542, an anti-skid cover member 550, and an anti-skid layer 560. An advantage of the pelvis support assembly 440 is that the assembly 440 supports the pelvis region 50 such that the vertebrates 81-85 having normal inward curve for decreased stress on the lumbar muscles, ligaments, and discs.

Referring to FIGS. 19-23, the bottom plate 500 is provided to operationally support the positional adjustment member 520 and the pelvis support plate 510 thereon. In one exemplary embodiment, the bottom plate 500 is constructed of plastic. In an alternative embodiment, the bottom plate 500 could be constructed of other materials known to those skilled in the art such as steel, stainless steel, aluminum, or wood for example. The bottom plate 500 includes a first end portion 566 and a second end portion 568. The bottom plate 500 further includes a top surface 570 and a bottom surface 572 disposed opposite to the top surface 570.

Figure 15:
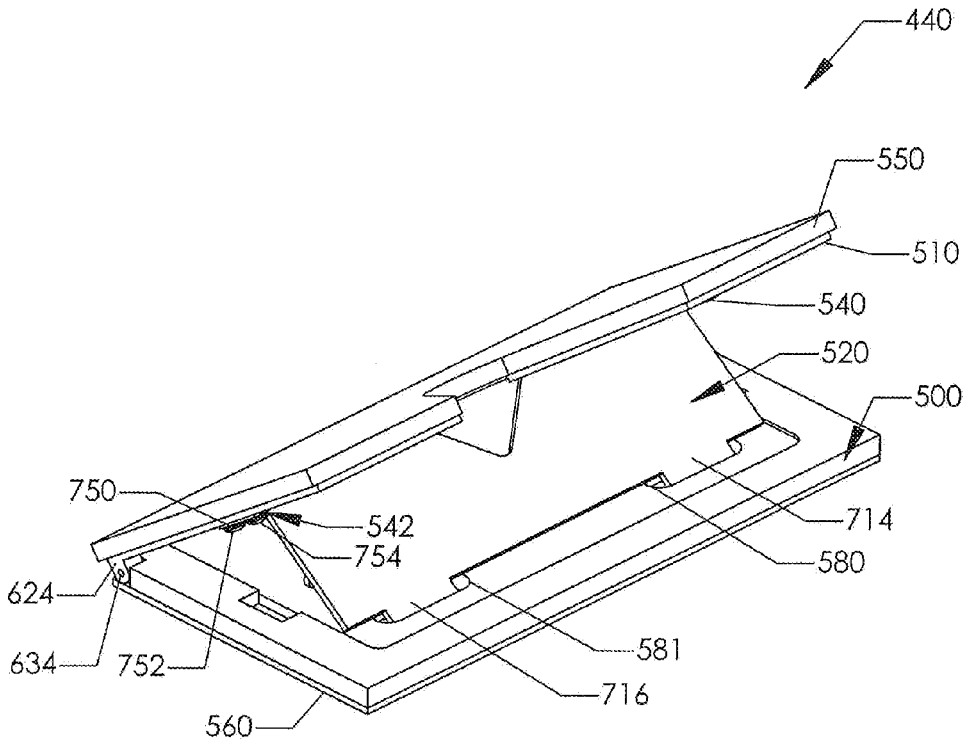
FIG. 15 is another schematic of the pelvis support assembly of FIG. 14.
Figure 16:
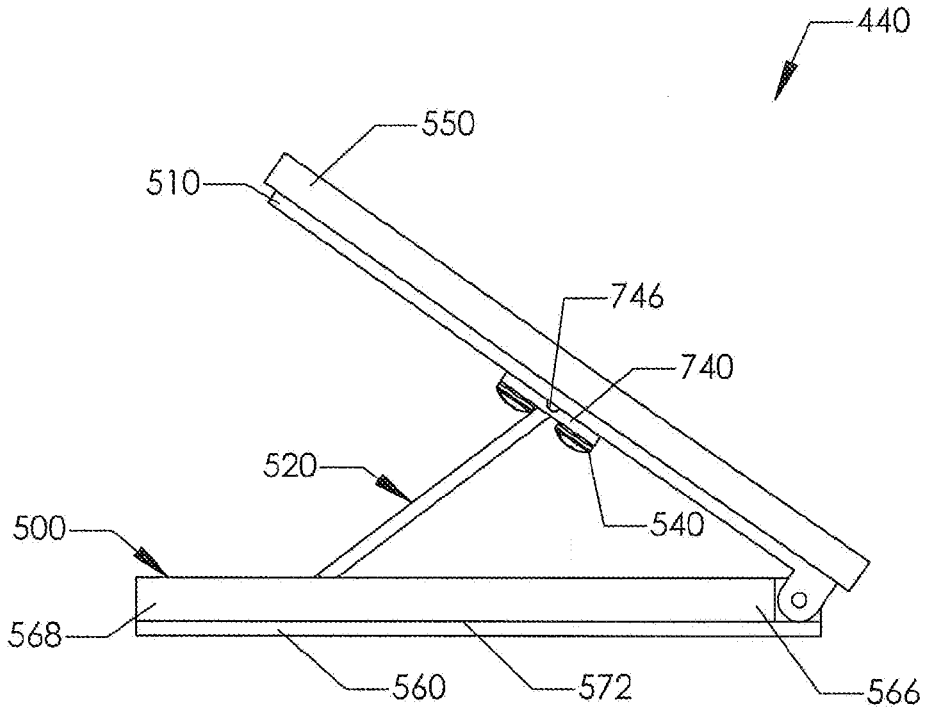
FIG. 16 is a side view of the pelvis support assembly of FIG. 14.
Figure 18:
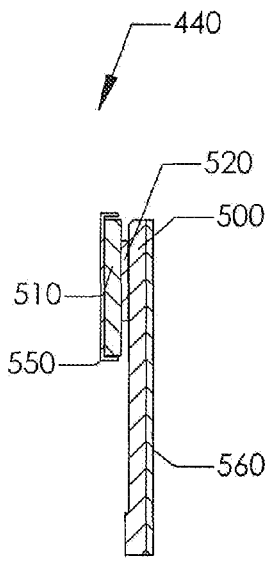
FIG. 18 is a cross-sectional view of a middle portion of the pelvis support assembly of FIG. 14 when the pelvis support assembly has a closed operational position.
Figure 19:
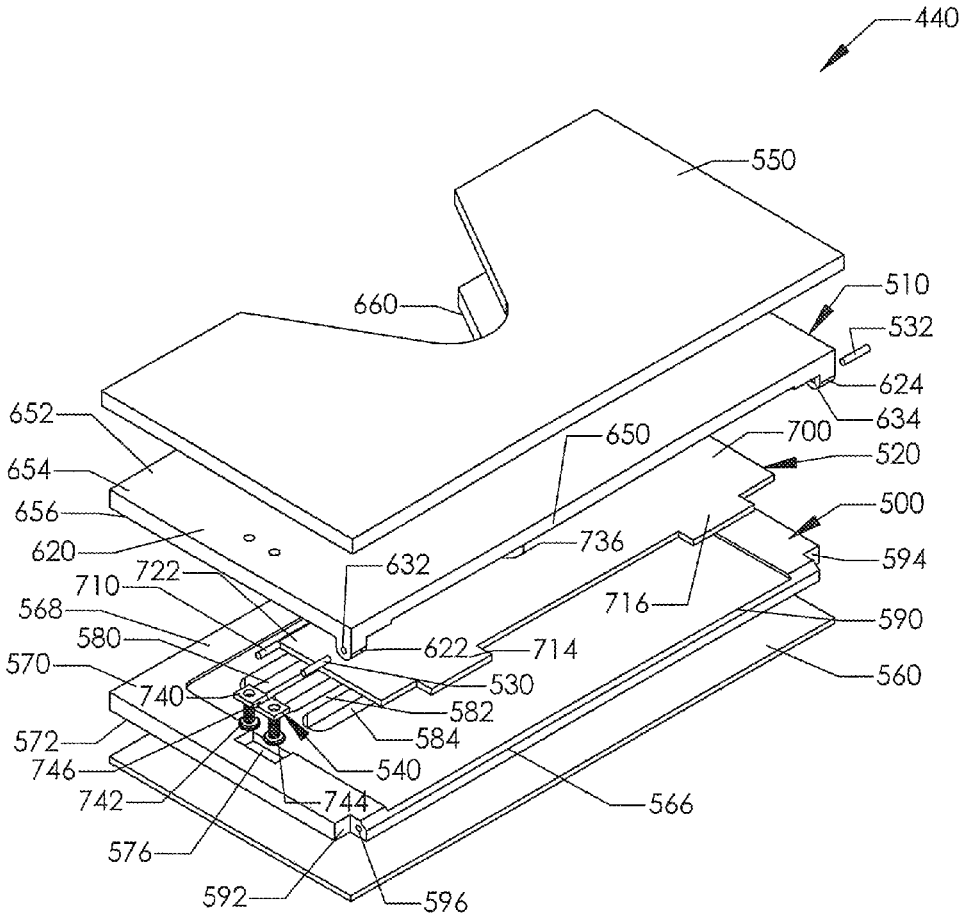
FIG. 19 is an exploded view of the pelvis support assembly of FIG. 14.
Figure 20:
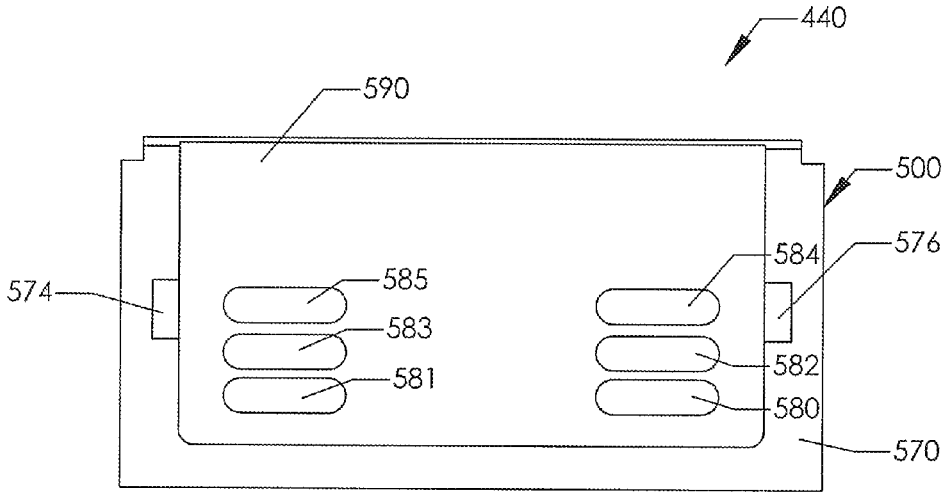
FIG. 20 is a top view of a bottom plate utilized in the pelvis support assembly of FIG. 14.

Referring to FIGS. 15, 19 and 20, the bottom plate 500 further includes grooves 574, 576, 590 extending from the top surface 570 into the bottom plate 500. The grooves 574, 576 are configured to receive the hinge members 540, 542 therein when the pelvis support plate 510 is disposed proximate to the bottom plate 500 and the pelvis support device 440 has a closed operational position (shown in FIG. 18). The groove 590 is configured to receive the positional adjustment member 520 when the pelvis support device 440 has a closed operational position.

Figure 21:
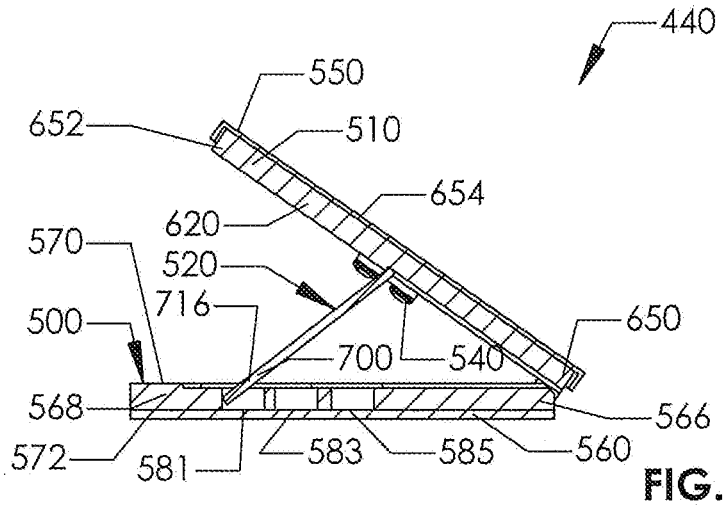
FIG. 21 is a cross-sectional view of the pelvis support assembly of FIG. 14 when a pelvis support plate therein has a first operational position.

Referring to FIG. 20, the bottom plate 500 further includes apertures 580, 581, 582, 583, 584, 585 extending through the bottom plate 500. Referring to FIGS. 15, 20, and 21, the apertures 580, 581 are configured to receive tab portions 714, 716, respectively, of the positional adjustment member 520 when the pelvis support plate 510 has a first operational position relative to the bottom plate 500. Further, referring to FIGS. 15, 20 and 22, the apertures 582, 583 are configured to receive tab portions 714, 716, respectively, of the positional adjustment member 520 when the pelvis support plate 510 has a second operational position relative to the bottom plate 500. Also, referring to FIGS. 15, 20 and 23, the apertures 582, 583 are configured to receive tab portions 714, 716, respectively, of the positional adjustment member 520 when the pelvis support plate 510 has a second operational position relative to the bottom plate 500.

Referring to FIG. 19, the bottom plate 500 further includes cut-out corner regions 592, 594 for receiving corresponding hinge extension portions 622, 624, respectively, of the pelvis support plate 510 therein. An aperture 596 communicating with the cut-out corner region 592 extends into the first end portion 566 of the bottom plate 500 for receiving a pin 530 therein. In particular, the pin 530 extends through an aperture 632 in the hinge extension portion 622 and the aperture 596 to rotatably couple the first end portion 650 of the pelvis support plate 510 to the first end portion 566 of the bottom plate 500. Similarly, an aperture (not shown) communicating with the cut-out corner region 594 extends into the first end portion 566 of the bottom plate 500 for receiving a pin 532 therein. In particular, the pin 532 extends through an aperture 634

(shown in FIG. 15) in the hinge extension portion 624 and the aperture proximate to the cut-out corner region 594 to rotatably couple the first end portion 650 of the pelvis support plate 510 to the first end portion 566 of the bottom plate 500.

Referring to FIGS. 2, 19 and 21, the pelvis support plate 510 is configured to support the pelvis region 50 of the human being 9. In one exemplary embodiment, the pelvis support plate 510 is constructed of plastic. In an alternative embodiment, the pelvis support plate 510 could be constructed of other materials known to those skilled in the art such as steel, stainless steel, aluminum, or wood for example. The pelvis support plate 510 includes a plate portion 620 and hinge extension portions 622, 624. The plate portion 620 includes a first end portion 650 and a second end portion 652. The plate portion 620 further includes a top surface 654 and a bottom surface 656 disposed opposite to the top surface 654.

Figure 14:
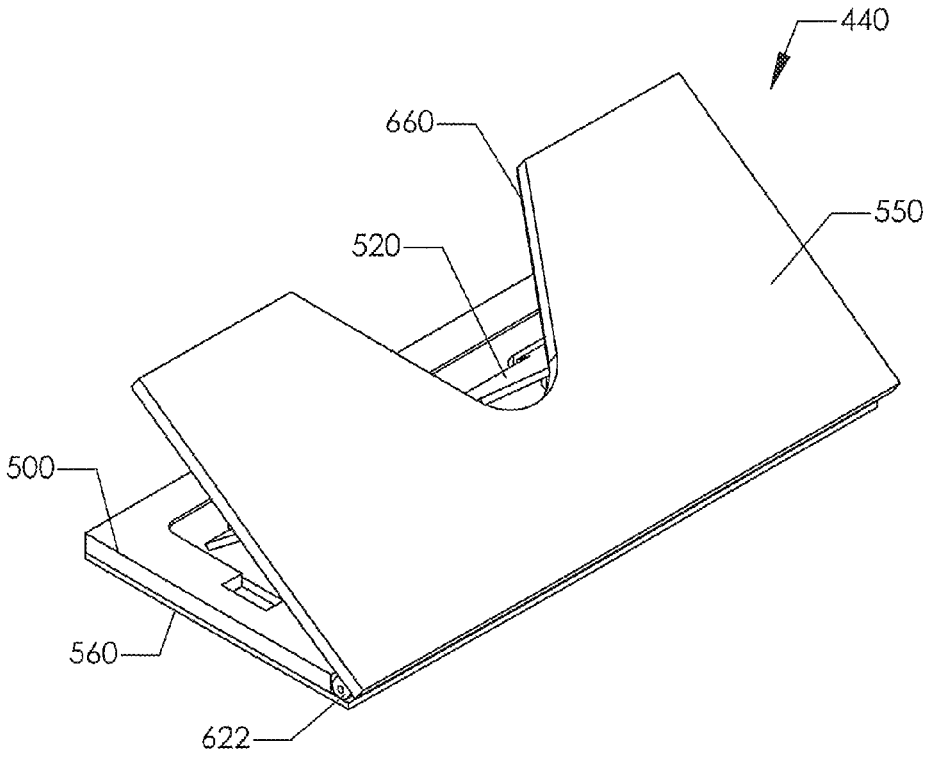
FIG. 14 is a schematic of a pelvis support assembly in accordance with another exemplary embodiment.

Referring to FIGS. 2, 14 and 19, the plate portion 620 has a cut-out portion 660 configured to allow a sacrum and tailbone 70 of the human pelvis region 50 to have a decreased pressure applied thereto from the plate portion 620. In particular, the cut-out portion 660 is centered about a centrally positioned axis 670 (shown in FIG. 17) on the plate portion 620 extending between the first and second end portions 650, 652 of the plate portion 620. The cut-out portion 660 extends from the second end portion 652 a predetermined distance toward the first end portion 650.

Referring to FIG. 19, the hinge extension portions 622, 624 are disposed on opposite corners of the first end portion 650 of the plate portion 620 of the pelvis support plate 510. The hinge extension portions 622, 624 extend downwardly from a bottom surface 656 of the plate portion 620. The hinge extension portion 622 includes an aperture 632 extending therethrough, and the hinge extension portion 624 includes an aperture 634 extending therethrough. The apertures 632, 634 are disposed co-linear with one another. The aperture 632 is configured to receive the pin 530 therethrough for rotatably coupling the hinge extension portion 622 to the first end portion 650 of the bottom plate 500. Also, that aperture 634 is configured to receive the pin 532 therethrough for rotatably coupling the hinge extension portion 624 to the first end portion 650 of the bottom plate 500.

Figure 17:
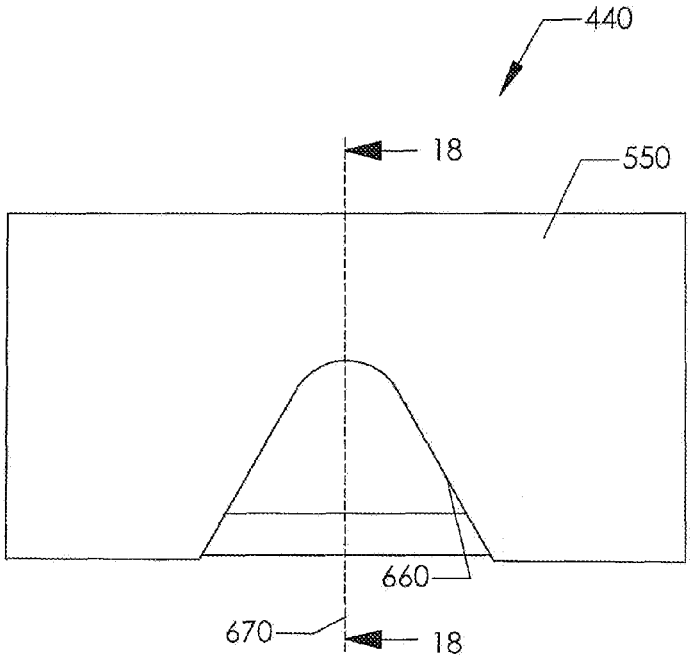
FIG. 17 is a top view of the pelvis support assembly of FIG. 14 when the pelvis support assembly has a closed operational position.

Referring to FIGS. 15, 17 and 19, the positional adjustment member 520 is operably positioned between the bottom plate 500 and the pelvis support plate 510 to adjust an operational position of the pelvis support plate 510. The positional adjustment member 520 configured to hold the pelvis support plate 510 at one of a plurality of operational positions relative to the bottom plate 500. In one exemplary embodiment, the positional adjustment member 520 is constructed of plastic. In an alternative embodiment, the positional adjustment member 520 could be constructed of other materials known to those skilled in the art such as steel, stainless steel, aluminum, or wood for example. The positional adjustment member 520 includes a plate portion 700, a pin extension 710, another pin extension (not shown), and tab portions 714, 716.

Referring to FIG. 19, the pin extension 710 extends outwardly in a first direction from the second end portion 722 of the plate portion 700 of the positional adjustment member 520. The pin extension 710 is configured to be received within a groove 746 of the hinge member 540 such that the positional adjustment member 520 is pivotally coupled to the pelvis support plate 510.

Referring to FIGS. 15 and 19, the other pin extension (not shown) extends outwardly in a second direction (opposite to the first direction) from the second portion 722 of the plate portion 700. This other pin extension (not shown) is configured to be received within a groove of the hinge member 542 such that the positional adjustment member 520 is pivotally coupled to the pelvis support plate 510.

Referring to FIGS. 19 and 20, the tab portions 714, 716 extend outwardly from the first end portion 720 of the plate portion 700. The tab portion 714 is configured to be received within the apertures 580, 582, 584 in the bottom plate 500. The tab portion 716 is configured to be received within the apertures 581, 583, 585 in the bottom plate 500.

Referring to FIG. 19, the hinge member 540 is configured to rotatably couple the second end portion 322 of the positional adjustment member 520 with the pelvis support plate 510. The hinge member 540 includes a plate 740 having a pair of apertures extending therethrough that are configured to receive the bolts 742, 744 therethrough for coupling the plate 740 to the pelvis support plate 510. The plate 740 further includes a groove 746 for receiving the pin extension 710 of the positional adjustment member 520 therethrough.

Referring to FIGS. 15 and 19, the hinge member 542 is configured to rotatably couple the second end portion 722 of the positional adjustment member 520 with the pelvis support plate 510. The hinge member 542 includes a plate 750 having a pair of apertures extending therethrough that are configured to receive the bolts 752, 754 therethrough for coupling the plate 750 to the pelvis support plate 510. The plate 750 further includes a groove for receiving another pin extension (not shown) of the positional adjustment member 520 therethrough. In an alternative embodiment, other types of hinges could be utilized for hinge members 540, 542

Referring to FIGS. 15 and 20-23, a brief description of a method of adjusting an operational position of the pelvis support plate 510 utilizing the positional adjustment member 520 will be explained. In one exemplary embodiment, the positional adjustment member 520 can adjust an operational position of the pelvis support plate 510 relative to the bottom plate 500 corresponding to an angular range of 35-50 degrees.

Referring to FIGS. 20 and 21, when the first and second tab portions 714, 715 of the positional adjustment member 122 are disposed in the apertures 580, 581, respectively, the positional adjustment member 122 holds the pelvis support plate 510 at a first operational position of the plurality of operational positions relative to the bottom plate 500. In one exemplary embodiment, the first operational position corresponds to a 35° angle of inclination of the pelvis support plate 510 relative to the bottom plate 500.

Figure 22:
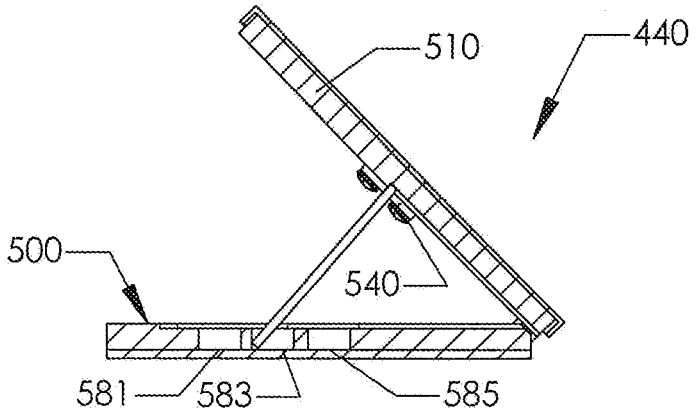
FIG. 22 is a cross-sectional view of the pelvis support assembly of FIG. 14 when the pelvis support plate therein has a second operational position.

Referring to FIGS. 20 and 22, when the first and second tab portions 714, 715 of the positional adjustment member 122 are disposed in the apertures 582, 583, respectively, the positional adjustment member 122 holds the pelvis support plate 510 at a second operational position of the plurality of operational positions relative to the bottom plate 500. In one exemplary embodiment, the second operational position corresponds to a 45° angle of inclination of the pelvis support plate 510 relative to the bottom plate 500.

Figure 23:
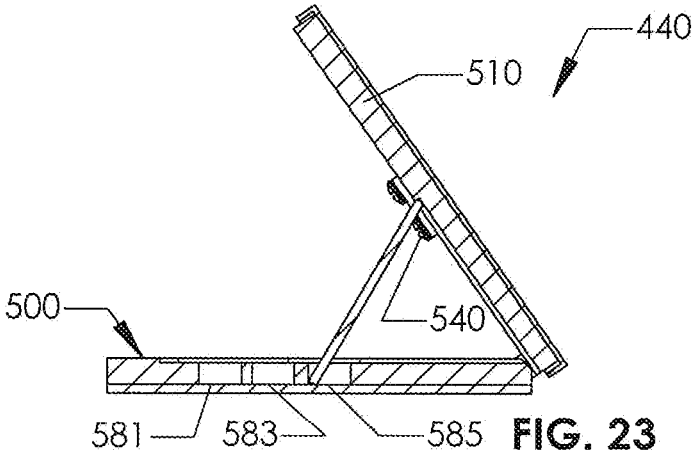
FIG. 23 is a cross-sectional view of the pelvis support assembly of FIG. 14 when the pelvis support plate therein has a third operational position.
Figure 24:
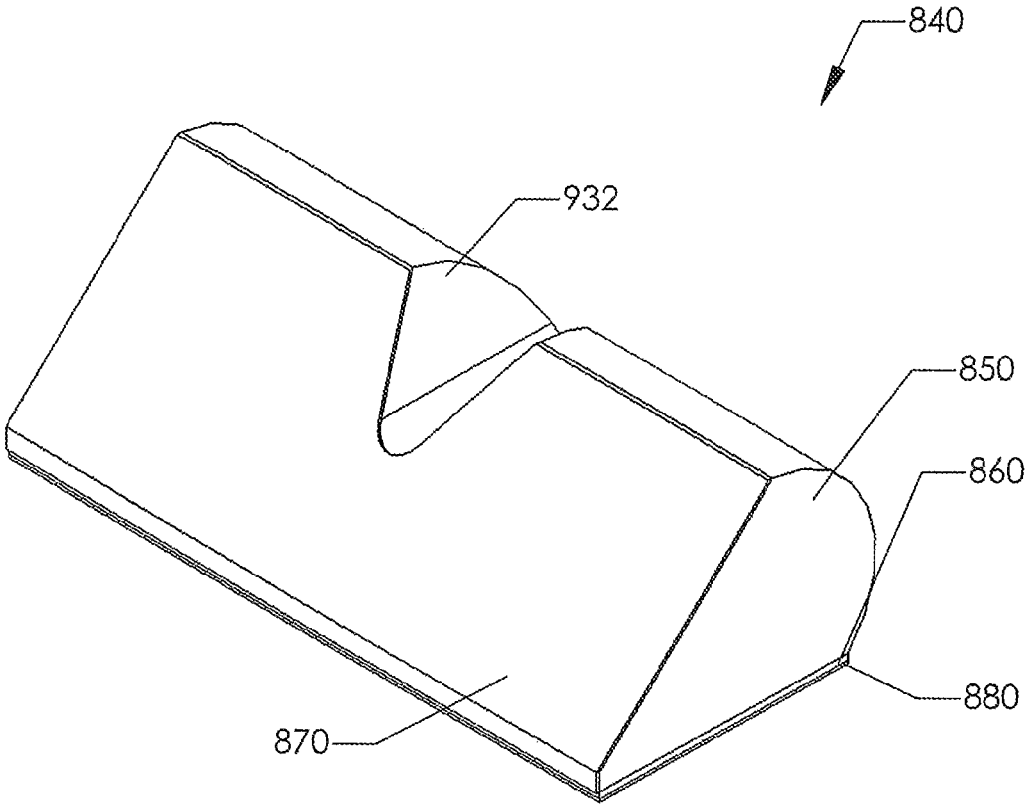
FIG. 24 is a schematic of a pelvis support assembly in accordance with another exemplary embodiment.
Figure 25:
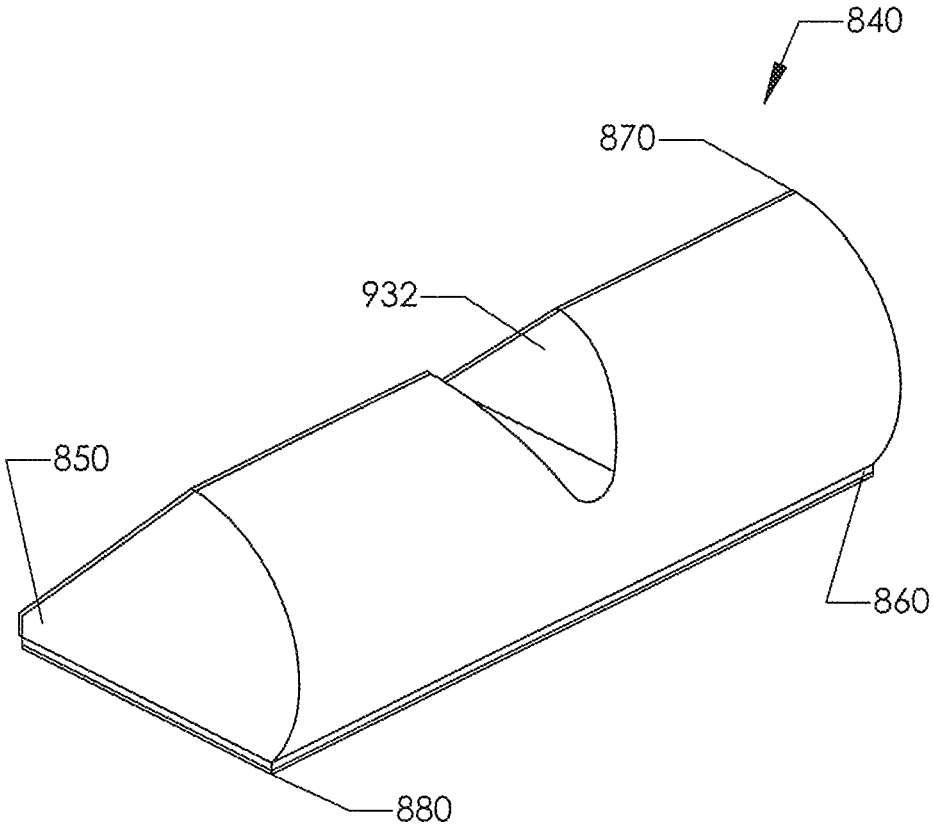
FIG. 25 is another schematic of the pelvis support assembly of FIG. 24.

Referring to FIGS. 20 and 23, when the first and second tab portions 714, 715 of the positional adjustment member 122 are disposed in the apertures 584, 585, respectively, the positional adjustment member 122 holds the pelvis support plate 510 at a third operational position of the plurality of operational positions relative to the bottom plate 500. In one exemplary embodiment, the third operational position corresponds to a 50° angle of inclination of the pelvis support plate 510 relative to the bottom plate 500.

Referring to FIGS. 14, 15, 19 and 21, the anti-skid cover member 550 is configured to be disposed on at least an outer surface 654 of the pelvis support plate 510, and/or may further extend to the bottom surface 656. The anti-skid cover member 550 may further be disposed around peripheral edges of the pelvis support plate 510. In one exemplary embodiment, the anti-skid cover member 550 is constructed of plastic. In an alternative embodiment, the anti-skid cover member 550 could be constructed of other materials known to those skilled in the art such as elastomeric materials.

Referring to FIGS. 2, and 14-16, the anti-skid layer 560 is configured to minimize and/or prevent the pelvis support assembly 440 from sliding on the seat bottom 9. The anti-skid layer 560 is disposed on a bottom surface 572 of the bottom plate 500.

Referring to FIGS. 17 and 18, the pelvis support assembly 440 is configured to have a compact closed operational position such that positional adjustment member 520 is disposed in the groove 590 of the bottom plate 500, and the pelvis support plate 510 is disposed adjacent to the bottom plate 500.

Third Pelvis Support Assembly Embodiment

Referring to FIGS. 2 and 24-29, a pelvis support assembly 840 in accordance with another exemplary embodiment is illustrated. The pelvis support assembly 840 supports the pelvis region 50 of the human being 9 (shown in FIG. 2) when the human being 9 is in a sitting position. The pelvis support assembly 840 includes a substantially wedge-shaped member 850, a rigid plate 860, an anti-skid layer 870, and an anti-skid layer 880. An advantage of the pelvis support assembly 840 is that the assembly 840 supports the pelvis region 50 such that the vertebrates 81-85 having normal inward curve for decreased stress on the lumbar muscles, ligaments, and discs.

Figure 26:
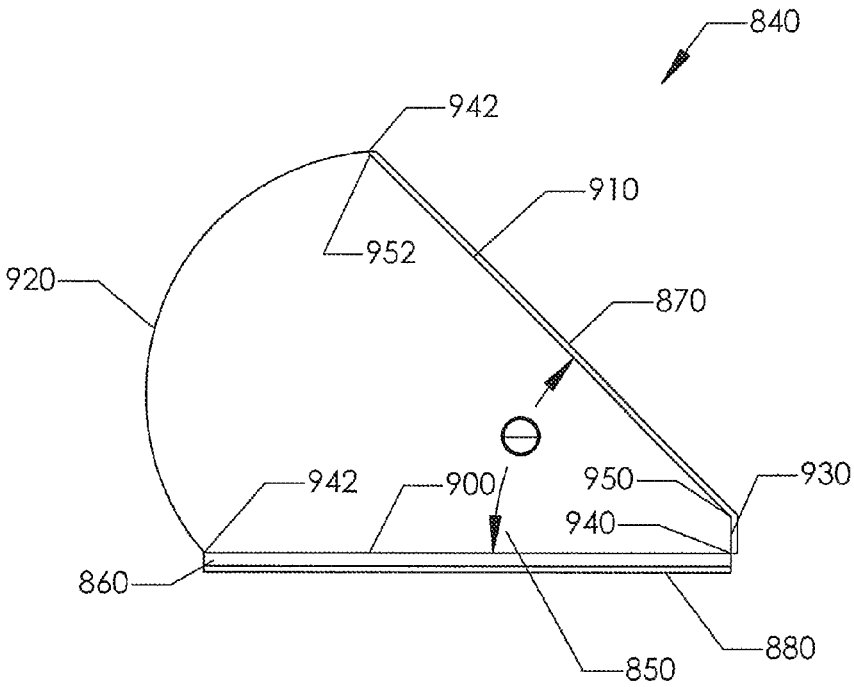
FIG. 26 is a side view of the pelvis support assembly of FIG. 24.
Figure 27:
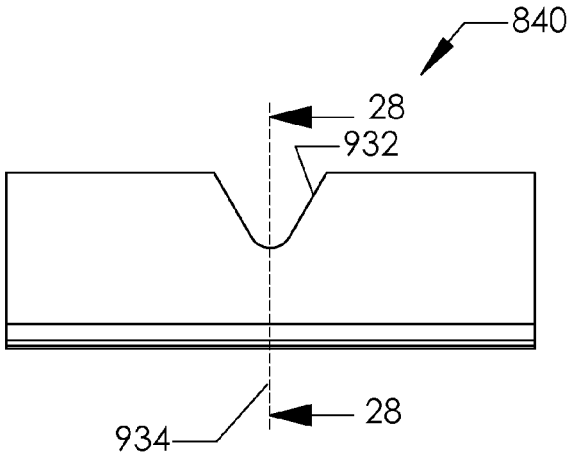
FIG. 27 is a front view of the pelvis support assembly of FIG. 24.
Figure 28:
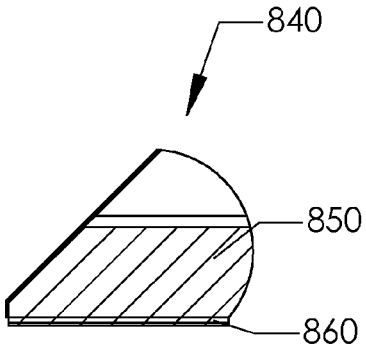
FIG. 28 is a cross-sectional view of the pelvis support assembly of FIG. 24.

Referring to FIG. 26, the substantially wedge-shaped member 850 has a bottom surface 900, a support surface 910, and a rear surface 920, and a front surface 930. The support surface 910 has a first end 950 and a second end 952. The bottom surface 900 has a first end 940 and a second end 942. The support surface 910 extends at a predetermined angle relative to the bottom surface 900. The front surface 930 extends from the first end 950 of the support surface 910 to the first end 940 of the bottom surface 900. The rear surface 920 extends from the second end 952 of the support surface 910 to the second end 942 of the bottom surface 900. The support surface 910 is sized to support the human pelvis region 50 thereon.

Referring to FIGS. 24-29, the substantially wedge-shaped member 850 further includes a cut-out portion 932 configured to allow a sacrum and tailbone 70 of the human pelvis region 50 to have a decreased pressure applied thereto from the wedge-shaped member 850. The cut-out portion 932 is centered about a centrally positioned axis 934 on the support surface 910 and the portion 932 extends into the substantially wedge-shaped member 850. The cut-out portion 932 extends from the second end 952 of the support surface 910 a predetermined distance toward the first end 950 of the support surface 910. In one exemplary embodiment, the wedge-shaped member 850 is constructed of plastic. Of course, in an alternative embodiment, the wedge-shaped member 850 could be constructed of other materials known to those skilled in the art, such as elastomeric materials for example.

The rigid plate 860 is coupled to the bottom surface 900 of the substantially wedge-shaped member 850. In one exemplary embodiment, the rigid plate 860 is constructed of plastic. Of course, in an alternative embodiment, the rigid plate 860 could be constructed of other materials known to those skilled in the art such as steel, stainless steel, aluminum, or wood for example.

In one exemplary embodiment, the rigid plate 860 is constructed of a first material and the substantially wedge-shaped member 850 is constructed of a second material different than the first material.

Figure 29:
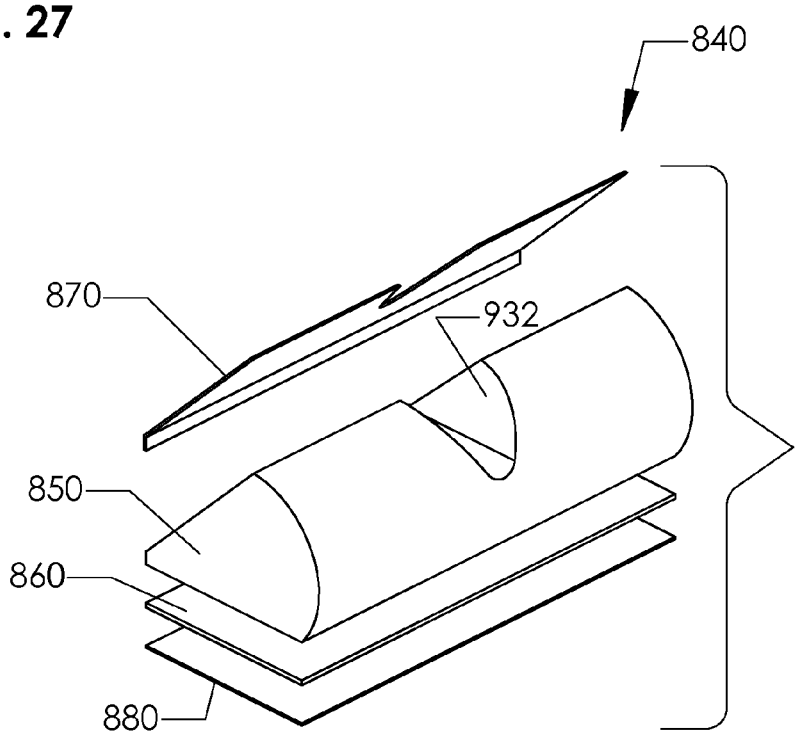
FIG. 29 is an exploded view of the pelvis support assembly of FIG. 24.

Referring to FIGS. 26 and 29, the anti-skid layer 870 is disposed on the support surface 910 of the substantially wedge-shaped member 850. The anti-skid layer 870 is configured to prevent the pelvis region 50 (shown in FIG. 2) from sliding on the support surface 910 when the human being 9 is a stationary sitting position.

The anti-skid layer 880 is disposed on a bottom surface of the rigid plate 860. The anti-skid layer 880 is configured to prevent the pelvis support assembly 840 from sliding on the seat bottom 10 (shown in FIG. 2).

It should be noted that the substantially wedge-shaped member 850 can be manufactured such that the angle between the support surface 910 and the bottom surface 900 is a range of 35-50 degrees.

The pelvis support assemblies disclosed herein provide a substantial advantage over other assemblies. In particular, the pelvis support assemblies 40, 440 provide a technical effect of utilizing a pelvis support plate sized to support a pelvis region and a positional adjustment member 520 to adjust an operational angle of the pelvis support plate. The pelvis support assembly 840 provides a technical effect of utilizing a substantially wedge-shaped member 850 to support a pelvis region.

While the claimed invention has been described in detail in connection with only a limited number of embodiments, it should be readily understood that the invention is not limited to such disclosed embodiments. Rather, the claimed invention can be modified to incorporate any number of variations, alterations, substitutions or equivalent arrangements not heretofore described, but which are commensurate with the spirit and scope of the invention. Additionally, while various embodiments of the claimed invention have been described, it is to be understood that aspects of the invention may include only some of the described embodiments. Accordingly, the claimed invention is not to be seen as limited by the foregoing description.

What is claimed is:

1. A pelvis support assembly, comprising:

a bottom plate having a first end portion and a second end portion;

a pelvis support plate having a first end portion and a second end portion, the first end portion of the pelvis support plate being pivotally coupled to the first end portion of the bottom plate, the pelvis support plate being sized to support a human pelvis region thereon, the pelvis support plate has a cut-out portion configured to allow a sacrum and tailbone of the human pelvis region to have to a decreased pressure applied thereto from the pelvis support plate, the cut-out portion being centered about a centrally positioned axis on the pelvis support plate, the cut-out portion further extending from an outer edge of the second end portion of the pelvis support plate a predetermined distance toward the first end portion of the pelvis support plate; and a positional adjustment member operably coupled between the bottom plate and the pelvis support plate, the positional adjustment member configured to hold the pelvis support plate at one of a plurality of operational positions relative to the bottom plate.

2. The pelvis support assembly of claim 1, wherein the cut-out portion is substantially triangular shaped.

3. The pelvis support assembly of claim 1, wherein the cut-out portion has a first width at the outer edge of the second end portion of the pelvis support plate which is greater than a width of the cut-out portion at the predetermined distance toward the first end portion of the pelvis support plate.

4. The pelvis support assembly of claim 1, further comprising an anti-skid layer disposed on a bottom surface of the bottom plate, the anti-skid layer configured to prevent the bottom plate from skidding on a surface of a chair.

5. The pelvis support assembly of claim 1, further comprising an anti-skid cover member configured to be disposed on at least an outer surface of the pelvis support plate, the anti-skid cover member further includes a cut-out region that is substantially similar in size and shape as the cut-out portion of the pelvis support plate, the cut-out region being disposed proximate to the cut-out portion.

6. The pelvis support assembly of claim 5, wherein the anti-skid cover member is constructed of an anti-skid plastic.

7. The pelvis support assembly of claim 1, wherein the cut-out portion further defines an inner edge of the pelvis support plate that extends inwardly from the outer edge of the pelvis support plate toward the first end portion of the pelvis support plate, the inner edge defining first, second, and third edge portions, the first edge portion extending from a first position on the pelvis support plate at an acute angle relative to the centrally positioned axis to the outer edge of the pelvis support plate, the second edge portion extending from a second position on the pelvis support plate at an acute angle relative to the centrally positioned axis to the outer edge of the pelvis support plate.

8. The pelvis support assembly of claim 7, wherein the third edge portion is an arcuate-shaped edge portion and extends from the first position to the second position on the pelvis support plate.

9. The pelvis support assembly of claim 1, wherein the positional adjustment member includes a plate portion with a first end and a second end disposed substantially parallel to the first end, the plate portion being rotatably coupled at the first end thereof to the pelvis support plate, the second end being configured to removably engage the bottom plate, the plate portion having a groove extending therein from the first end toward the second end.

10. A pelvis support assembly of claim 9, wherein the groove of the plate portion of the positional adjustment member is disposed proximate to the cut-out portion of the pelvis support plate.

11. The pelvis support assembly of claim 1, wherein the bottom plate has a first groove configured to receive a portion of the positional adjustment member therein, such that the positional adjustment member holds the pelvis support plate at a first operational position of the plurality of operational positions relative to the bottom plate when the portion of the positional adjustment member is disposed in the first groove.

12. The pelvis support assembly of claim 11, wherein the first operational position is in an angular range of 35-50 degrees.

13. The pelvis support assembly of claim 11, wherein the bottom plate has a second groove configured to receive the portion of the positional adjustment member therein, such that the positional adjustment member holds the pelvis support plate at a second operational position of the plurality of operational positions relative to the bottom plate when the portion of the positional adjustment member is disposed in the second groove.

14. A pelvis support assembly, comprising:

a bottom plate having a first end portion and a second end portion;

a pelvis support plate having a first end portion and a second end portion, the first end portion of the pelvis support plate being pivotally coupled to the first end portion of the bottom plate, the pelvis support plate being sized to support a human pelvis region thereon, the pelvis support plate has a cut-out portion configured to allow a sacrum and tailbone of the human pelvis region to have to a decreased pressure applied thereto from the pelvis support plate, the cut-out portion being centered about a centrally positioned axis on the pelvis support plate, the cut-out portion further extending from an outer edge of the second end portion of the pelvis support plate a predetermined distance toward the first end portion of the pelvis support plate, the cut-out portion having a first width at the outer edge of the second end portion of the pelvis support plate which is greater than a width of the cut-out portion at the predetermined distance toward the first end portion of the pelvis support plate; and a positional adjustment member having a plate portion with a first end and a second end disposed substantially parallel to the first end, the plate portion being rotatably coupled at the first end thereof to the pelvis support plate, the second end being configured to removably engage the bottom plate at one of a plurality of operational positions, the plate portion having a groove extending therein from the first end toward the second end.

15. A pelvis support assembly of claim 14, wherein the groove of the plate portion of the positional adjustment member is disposed proximate to the cut-out portion of the pelvis support plate.

* * * * *